US007889033B2

(12) United States Patent
Bollinger et al.

(10) Patent No.: US 7,889,033 B2
(45) Date of Patent: Feb. 15, 2011

(54) ELECTROMAGNETIC DEVICE WITH DISPLACEABLE CONNECTIONS

(75) Inventors: Georg Bollinger, Schwarzhofen (DE); Johann Drexler, Schwandorf (DE)

(73) Assignee: Siemens Aktiengesellschaft, Munich (DE)

( * ) Notice: Subject to any disclaimer, the term of this patent is extended or adjusted under 35 U.S.C. 154(b) by 260 days.

(21) Appl. No.: 12/076,041

(22) Filed: Mar. 13, 2008

(65) Prior Publication Data

US 2008/0231399 A1 Sep. 25, 2008

(30) Foreign Application Priority Data

Mar. 19, 2007 (DE) ..... 10 2007 013 052

(51) Int. Cl.
*H01H 67/02* (2006.01)

(52) U.S. Cl. ..... 335/132; 335/202; 335/78

(58) Field of Classification Search ..... 335/78–86, 335/131, 132, 202
See application file for complete search history.

(56) References Cited

U.S. PATENT DOCUMENTS 5,281,937 A * 1/1994 Young ..... 335/132
5,684,442 A * 11/1997 Hufschmid ..... 335/132
5,724,018 A * 3/1998 Brandl et al. ..... 336/192
7,679,477 B2 * 3/2010 Portier ..... 335/132
2005/0068132 A1 * 3/2005 Marquardt et al. ..... 335/202
2008/0174391 A1 * 7/2008 Bolz et al. ..... 335/202

FOREIGN PATENT DOCUMENTS

DE 3017561 11/1981
DE 4406682 9/1994

* cited by examiner

*Primary Examiner*—Anh T Mai
*Assistant Examiner*—Bernard Rojas
(74) *Attorney, Agent, or Firm*—Harness, Dickey & Pierce, P.L.C.

(57) ABSTRACT

An electromagnetic switching device for controlling a branch includes, in at least one embodiment, a housing with a length in a longitudinal direction, with a first end side, which is oriented at right angles with respect to the longitudinal direction, and with a second end side, which is opposite the first end side and is oriented at right angles with respect to the longitudinal direction; a control coil, which is arranged in the housing, for actuating an electrical switch with a first and second coil contact; and a first and second connection element, which are arranged partially in the housing. In at least one embodiment, the connection elements are capable of being displaced in the longitudinal direction relative to the housing between a first and a second end position in such a way that they are freely accessible on one of the end sides in the first end position, are freely accessible on the other of the end sides in a second end position, and are electrically connected to the associated coil contacts both in the first end position and in the second end position.

18 Claims, 4 Drawing Sheets

ELECTROMAGNETIC DEVICE WITH DISPLACEABLE CONNECTIONS

PRIORITY STATEMENT

The present application hereby claims priority under 35 U.S.C. §119 on German patent application number DE 10 2007 013 052.1 filed Mar. 19, 2007, the entire contents of which is hereby incorporated herein by reference.

FIELD

Embodiments of the invention generally relate to an electromagnetic switching device for controlling a branch.

BACKGROUND

Electromagnetically actuated switches, contactors, for closing or opening a main circuit, possibly with a high power consumption, are known. In this case, a magnetic field is produced by way of a control current flowing through a coil, by which magnetic field an electrical contact is actuated mechanically, which electrical contact closes or opens the main circuit. Contactors are often combined with motor circuit breakers, overload relays or fuses, in particular in switchgear assemblies, but can also be used when installed individually.

Depending on the use, in this case connections are required sometimes on one side of the contactor, sometimes on the opposite side of the contactor, and sometimes on both sides of the contactor. Generally, the position of the connections on the contactor is fixedly predetermined by the manufacturer. Thus, the connecting feed lines possibly need to be routed via the contactor, which is unclear, makes access to the contactor more difficult and, in particular in the case of a large number of connections, can result in wiring errors.

DE 30 17 561 C2 has disclosed an electromagnetic switching device with connection terminals which can be plugged in. The connection terminals can be plugged into the switching device or removed therefrom depending on requirements and spatial conditions.

DE 44 06 682 C2 has disclosed a contactor with a plurality of coil terminals. In this case, an external wiring section can be connected to one of the coil terminals or removed from the contactor, depending on requirements and on the arrangement of the contactor.

SUMMARY

In at least one embodiment of the invention, a contactor is disclosed in which the position of the connections can be matched in a simple manner to the respective requirements.

At least one embodiment of the invention resides in the fact that the contactor has connection elements, which are capable of being displaced in the longitudinal direction relative to the housing of the contactor.

The displaceability of the connection elements makes it possible to match the contactor to the respective requirements in a simple and flexible manner. One advantage of at least one embodiment resides in the fact that the connection elements, as a result of their displaceability, can be made freely accessible precisely on the side on which they are required. Thus, it is no longer necessary for connection wires to be routed via the contactor in an unorderly and inhibiting manner. In addition, wiring errors when connecting a device to the contactor are avoided, since the connections of the contactor are in each case only freely accessible on one side.

Advantageously, the housing of the contactor protrudes completely in the longitudinal direction over the connection elements on the freely accessible, respectively opposite side, i.e. the connections do not protrude beyond the housing of the contactor on this side. This prevents space being wasted unnecessarily as a result of unused connections.

Advantageously, it is furthermore provided that the connection elements have, in the longitudinal direction, a length which exceeds the length of the housing by at most one centimeter, in particular by at most 0.5 centimeter, in particular not at all. As a result, the maximum installation length of the contactor is limited.

Favorably, the first connection element is designed to be identical to the second connection element. This makes it possible to produce the contactor in a particularly simple manner since the manufacturing embodiment is identical irrespective of the ultimately required position of the connection elements.

Advantageously, the electrical connection between the coil contacts and the associated coil connections is in the form of a clamping contact, which firstly results in a good electrical contact, and secondly the coil connections are mechanically prevented from sliding unintentionally.

Advantageously, the control coil is replaceable, which results in increased flexibility of the contactor and simplified and cost-effective maintenance.

BRIEF DESCRIPTION OF THE DRAWINGS

Further features and details of the invention result from the description of example embodiments with reference to the drawings, in which.

DETAILED DESCRIPTION OF THE EXAMPLE EMBODIMENTS

Figure 1:
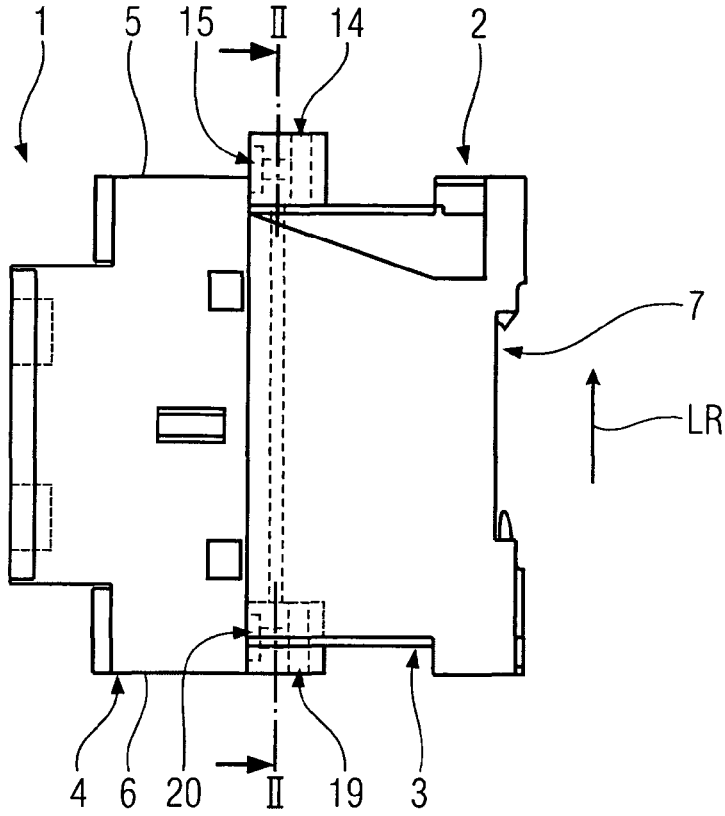
FIG. 1 shows a side view of a contactor in accordance with one example embodiment.
Figure 2:
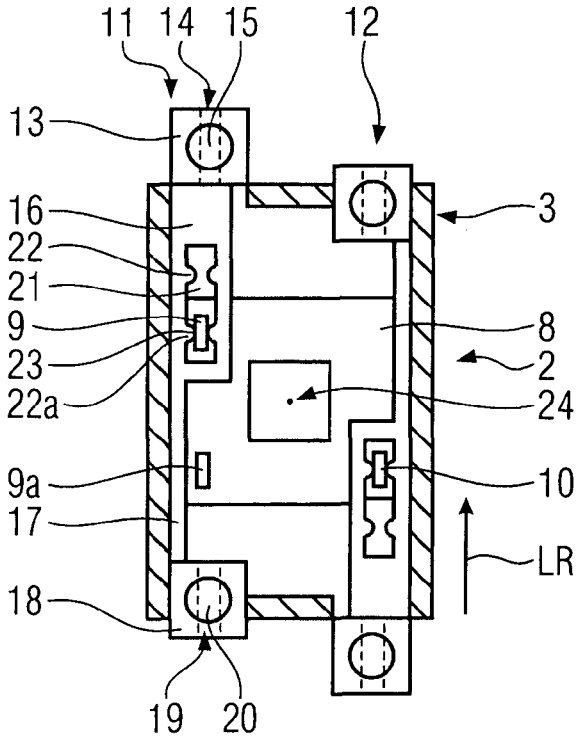
FIG. 2 shows a section through the contactor along the line II-II.
Figure 3:
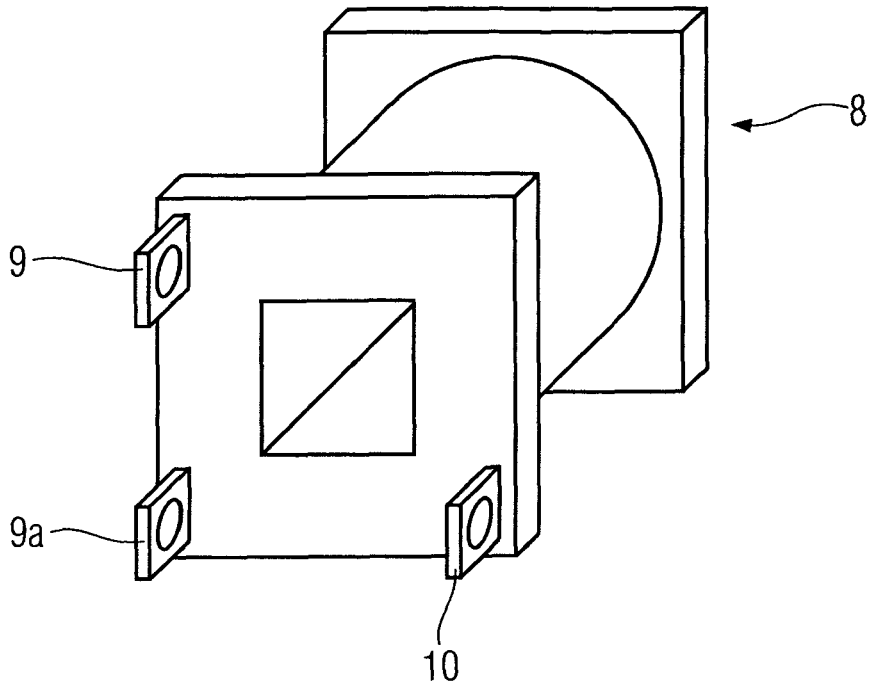
FIG. 3 shows a 3D view of a coil.

Various example embodiments will now be described more fully with reference to the accompanying drawings in which only some example embodiments are shown. Specific structural and functional details disclosed herein are merely representative for purposes of describing example embodiments. The present invention, however, may be embodied in many alternate forms and should not be construed as limited to only the example embodiments set forth herein.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

In the text which follows, a first example embodiment of the invention will be described with reference to FIGS. 1 to 4. An electromagnetic switching device, contactor 1, has a housing 2 with a longitudinal direction LR. The housing 2 has a length $L_G$ in the longitudinal direction LR. The housing 2 includes an insulating material, in particular plastic. The housing 2 includes a housing lower part 3 and a housing upper part 4, which is connected detachably thereto. The housing 2 is delimited in the longitudinal direction LR by a first end side 5 and a second end side 6 which is opposite thereto. The housing lower part 3 has a specially designed fastening cutout 7 for fastening the housing 2 on a fastening rail (not illustrated) provided for this purpose.

A coil 8 (shown in FIG. 3) with a first coil contact 9 and a second coil contact 10 is arranged in the housing lower part 3 in such a way that it is fixed against displacement. In accordance with the example embodiment illustrated in FIG. 2, the coil 8 is in the form of a three-limbed coil with a third coil contact 9*a*. As an alternative to this, the coil 8 can also have only two coil contacts 9, 10 or can be in the form of a four-limbed coil. The coil contacts 9, 9*a*, 10 are in the form of platelet-like plug-in contacts, which protrude at right angles with respect to the longitudinal direction LR and whose narrow side points in the longitudinal direction LR.

Alternative geometric configurations which are not illustrated in the figures of the coil contacts are also conceivable. The first coil contact 9 is electrically connected to a connection element in the form of a first coil connection 11. Correspondingly, the second coil contact 10 is electrically connected to a connection element in the form of a second coil connection 12. The coil connections 11, 12 are capable of being displaced in the longitudinal direction LR relative to the housing 2 and the coil 8, which is connected thereto in such a way that it is fixed against displacement.

In a particularly advantageous embodiment, the coil connections 11, 12 have, in the longitudinal direction LR, a length $L_A$, for which the following applies: $L_A \leqq L_G + 1$ cm, in particular $L_A \leqq L_G + 0.5$ cm, in particular $L_A \leqq L_G$.

Figure 4:
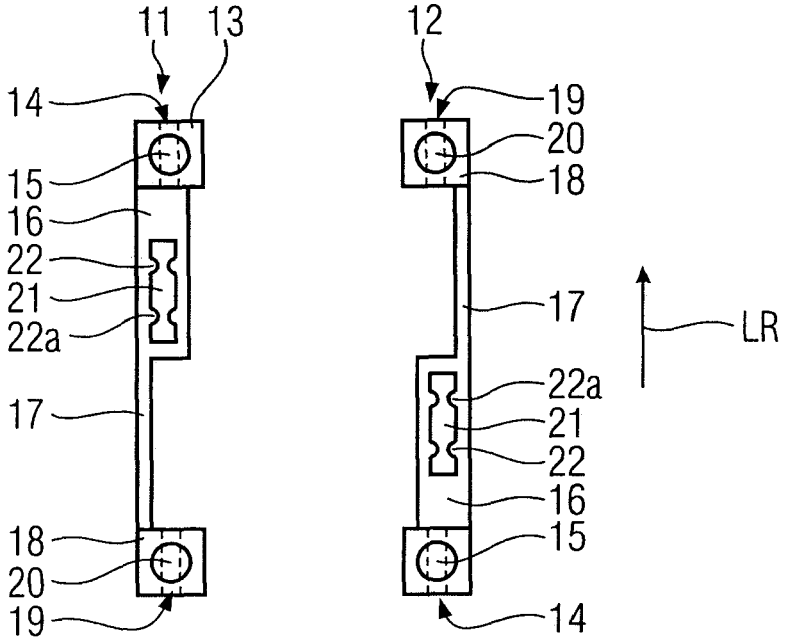
FIG. 4 shows a separate view of the connection elements.

The first coil connection 11 shown separately in FIG. 4 includes a first connection block 13, which is arranged in the longitudinal direction LR at a first end of the coil connection 11, with a first connection opening 14, which is aligned in the longitudinal direction LR, and a first connection fixing screw 15, which is aligned at right angles with respect to the connection opening 14 and can be screwed into the connection opening 14. The first coil connection 11 furthermore comprises a contact piece 16, which is connected to the first connection block 13 in the opposite direction to the longitudinal direction LR, adjacent to this a connecting piece 17 and a second connection block 18, which is opposite the first connection block 13 and has a second connection opening 19 and a second connection fixing screw 20 corresponding to the embodiment of the first connection block 13. In an alternative variant embodiment which is not illustrated in the figures, in each case one spring-loading device is provided instead of the connection fixing screws 15, 20.

The connecting piece 17 is narrower than the contact piece 16 in the direction at right angles with respect to the longitudinal direction LR, with the result that it is separated from an optionally provided additional coil contact 9*a*, which is opposite the first coil contact 9 in the opposite direction to the longitudinal direction LR, by way of an air gap and therefore is not conductively connected to said contact. The entire coil connection 11 includes an electrically highly conductive metal.

The contact piece 16 has a cutout 21 with two constrictions 22, 22*a*, which are arranged one behind the other in the longitudinal direction LR, in each case one of the constrictions 22, 22*a* forming a clamping contact 23 with the first coil contact 9 depending on the position of the coil connection 11. In a preferred embodiment, the sheet-like coil contact 9 has annular latch-in elements, which are arranged on both sides centrally on its longitudinal sides and make it possible for the constrictions 22, 22*a* to latch in with the coil contact 9 in a defined manner. Alternative embodiments of such latch-in elements are likewise conceivable. The constrictions 22, 22*a* have a difference from one another in the longitudinal direction LR which corresponds substantially to the distance by which the coil connection 11 can be displaced in the longitudinal direction LR.

The length of this distance corresponds for its part substantially to the extent of the connection blocks 13, 18 in the longitudinal direction. The exact length of the distance by which the coil connection 11 can be displaced in the longitudinal direction LR is dependent on the dimensions of the coil contact 9 in the longitudinal direction LR and the embodiment of the cutout 21, in particular at its ends facing the connection blocks 13, 18. The coil connection 11 is in this case capable of being displaced in the longitudinal direction LR until the coil contact 9 stops against one of the ends of the cutout 21. This usually results, as for example in the exemplary embodiment illustrated in FIG. 2, in a displaceability which is slightly greater than the distance between the two constrictions 22, 22*a*.

In a first position of the first coil connection 11, the first connection block 13 protrudes beyond the housing 2 in the longitudinal direction LR at least to such an extent that it is freely accessible for the purpose of connecting a connecting wire. In particular, the first connection fixing screw 15 is freely accessible. The second connection block 18 is arranged at least largely within the housing 2 in this position of the first coil connection 11.

From this first end position, the first coil connection 11 can be displaced in the opposite direction to the longitudinal direction LR relative to the housing 2 and the coil 8, which is connected thereto in such a way that it is fixed against displacement, into a second end position. In the second end position, the constriction 22, which is free in the first end position, of the cutout 21 forms the clamping contact 23, with which the first coil connection 11 is electrically connected to the first coil contact 9. In contrast to the first end position, in the second end position the first connection block 13 is arranged at least largely in the housing 2, while the second connection block 18, in particular the second connection fixing screw 20, protrudes beyond the second end side 6, which is opposite the first end side 5, of the housing 2 in such a way that it is freely accessible.

The second coil connection 12 is identical in design terms to the first coil connection 11 and is arranged substantially point-symmetrically with respect to an axis of symmetry 24 with respect to the first coil connection 11. For the description of the second coil connection 12, reference is therefore made to the description of the first coil connection 11. The second coil connection 12 is in electrical contact with the second coil contact 10.

Connections of a main circuit which are conventional for a contactor and a switch which is actuated electromagnetically by the coil 8 are arranged in the housing upper part 4, not illustrated in the figures in any more detail.

Figure 7:
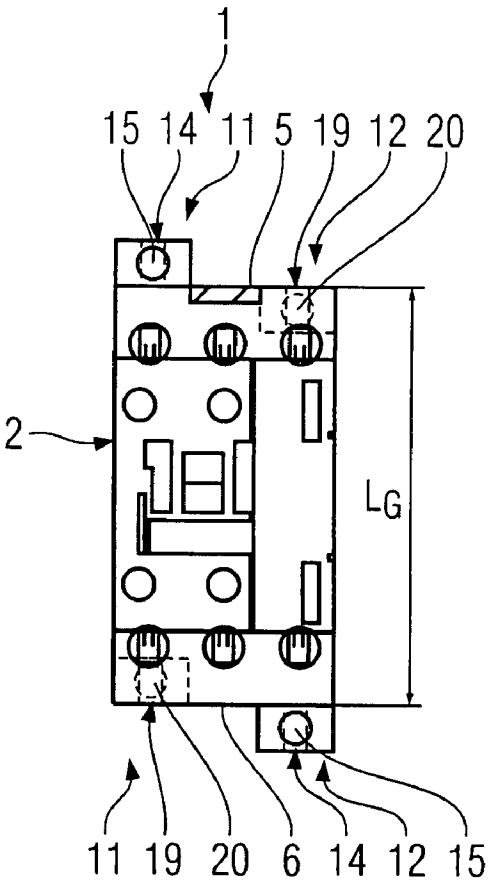
FIG. 7 shows a plan view of the contactor shown in FIG. 1 with the coil connections in a third position.
Figure 6:
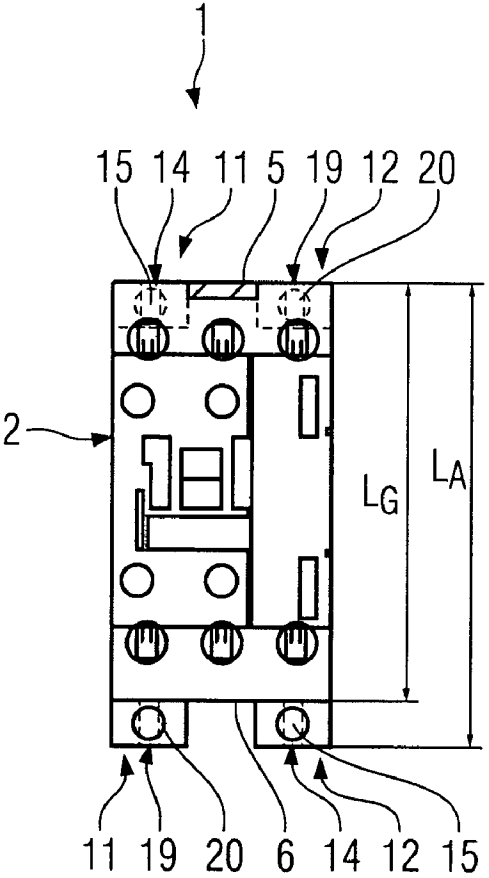
FIG. 6 shows a plan view of the contactor shown in FIG. 1 with the coil connections in a second position.
Figure 5:
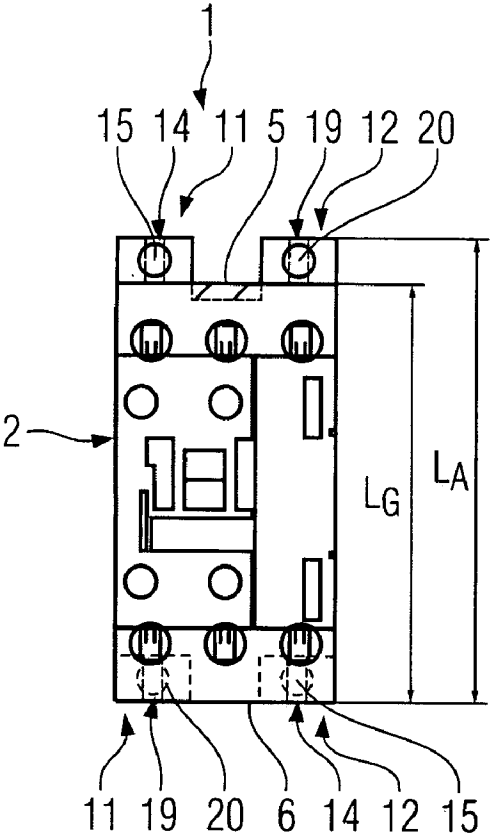
FIG. 5 shows a plan view of the contactor shown in FIG. 1 with the coil connections in a first position.

In the text which follows, the fitting of the contactor 1 will be described with reference to FIGS. 5 to 7. Usually, the contactor 1 with the fixing cutout 7 is plugged onto a rail provided specifically for this purpose. Depending on which further components are intended to be connected to the contactor and where these are arranged in relation to the contactor, it may be advantageous to wire the two coil connections 11, 12 together on the side of the first end side 5 (see FIG. 5) or on that of the second end side 6 (see FIG. 6) of the housing 2 or in each case one of the coil connections 11, 12 on the first end side 5 and the other on the second end side 6 (see FIG. 7).

For this purpose, each of the coil connections 11, 12 is displaced in a simple manner into the desired end position, where it is held as a result of the clamping contact 23 between the respective constriction 22, 22*a* and that one of the coil contacts 9, 10 which is associated with the respective coil connection 11, 12. In the desired end position, the respectively required connection block 13, 18 with the associated connection fixing screw 15, 20 is freely accessible for the purpose of wiring a device at the contactor. The opposite connection block 13, 18, which is not required for wiring a device, does not protrude beyond the housing 2 in this end position of the coil connection 11, 12 in the longitudinal direction LR, as a result of which this connection is prevented from being incorrectly wired.

Figure 8:
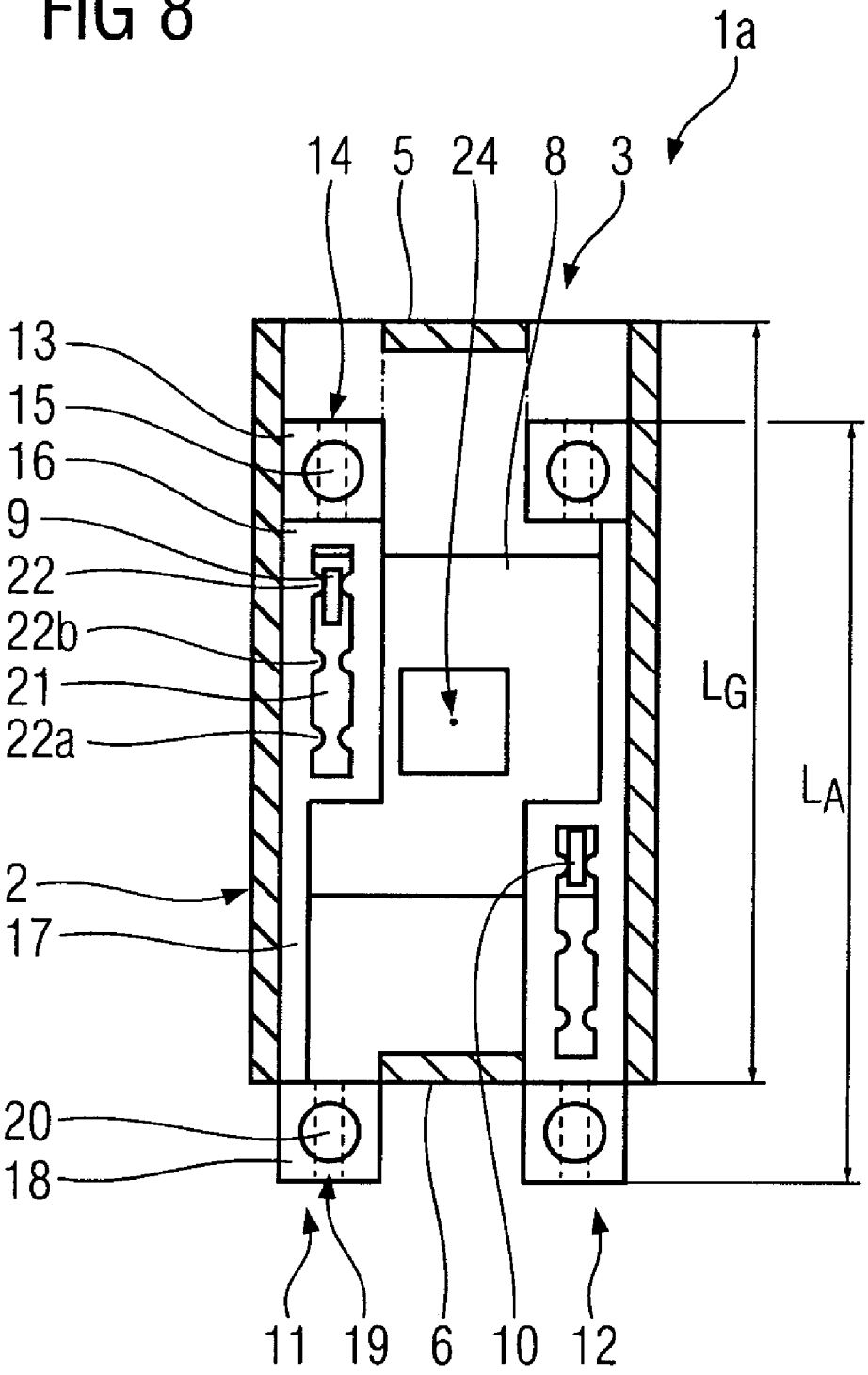
FIG. 8 shows a section through the contactor in accordance with a further example embodiment.

In the text which follows, a further embodiment of a contactor la will be described with reference to FIG. 8. In this particularly space-saving embodiment, it is possible to displace the coil connection 11, 12 once a device has been wired in the connection block 13, 18 into an additional mid-position between the first and second end position, in which mid-position the housing 2 protrudes completely beyond the coil connection 11, 12 both on the first end side 5 and on the second end side 6, i.e. the coil connection 11, 12 does not protrude beyond the housing 2 on any side in the longitudinal direction LR. For this purpose, a further constriction 22*b* is provided in the cutout 21, which constriction is arranged centrally between the first constriction 22 and the second constriction 22*a* and forms a clamping contact 23 with the respective coil contact 9, 10.

Further, elements and/or features of different example embodiments may be combined with each other and/or substituted for each other within the scope of this disclosure and appended claims.

Example embodiments being thus described, it will be obvious that the same may be varied in many ways. Such variations are not to be regarded as a departure from the spirit and scope of the present invention, and all such modifications as would be obvious to one skilled in the art are intended to be included within the scope of the following claims.

What is claimed is:

1. An electromagnetic switching device for at least one of connecting and disconnecting a branch, comprising:

a. a housing including i. a length along a longitudinal direction, ii. a first end side, oriented substantially at right angles with respect to the longitudinal direction, and iii. a second end side, opposite the first end side and oriented substantially at right angles to the longitudinal direction, b. a control coil, arranged in the housing, for actuating an electrical switch with i. at least one first coil contact, and ii. at least one second coil contact, c. a first connection element, arranged at least partially in the housing and associated with the first coil contact, and d. a second connection element, arranged at least partially in the housing and associated with the second coil contact, the first and second connection elements being displaceable in the longitudinal direction relative to the housing between a first and a second end position in such a way to be i. freely accessible on at least one of the end sides in the first end position, ii. freely accessible on at least the other of the end sides in a second end position, and iii. electrically connected to the respectively associated coil contacts, both in the first end position and in the second end position.

2. The switching device as claimed in claim 1, wherein the housing protrudes completely in the longitudinal direction over the coil connections, both in the first and in the second end position, on the freely accessible respectively opposite end side.

3. The switching device as claimed in claim 1, wherein the connection elements include an element length in the longitudinal direction, which exceeds the length of the housing by at most 1 cm.

4. The switching device as claimed in claim 1, wherein the first coil connection is designed to be identical to the second coil connection.

5. The switching device as claimed in claim 1, wherein the electrical connection between the coil contacts and the associated connection elements is in the form of a clamping contact.

6. The switching device as claimed in claim 5, wherein the connection element includes a cutout, which extends in the longitudinal direction, into which the respective coil contact engages and which includes, in each case, at least two constrictions so as to form the clamping contact.

7. The switching device as claimed in claim 1, wherein the control coil is replaceable.

8. The switching device as claimed in claim 1, wherein the connection elements, in addition to the first and second end position, are capable of being displaced into a mid-position between the first and second end position, in which mid-position the housing protrudes completely over the connection elements both on the first end side and on the second end side, and the connection elements in the mid-position are electrically connected to the respectively associated coil contacts.

9. The switching device as claimed in claim 3, wherein the connection elements include an element length in the longitudinal direction, which exceeds the length of the housing by at most 0.5 cm.

10. The switching device as claimed in claim 9, wherein the connection elements include an element length in the longitudinal direction, which does not exceed the length of the housing.

11. The switching device as claimed in claim 1, wherein the connection elements include an element length in the longitudinal direction, which does not exceed the length of the housing.

12. An electromagnetic switching device, comprising:

a housing including a length along a longitudinal direction;

a control coil, arranged in the housing, for actuating an electrical switch with at least one of at least one first coil contact, and at least one second coil contact;

a first connection element, arranged at least partially in the housing and associated with the first coil contact; and a second connection element, arranged at least partially in the housing and associated with the second coil contact, the first and second connection elements being displaceable in the longitudinal direction relative to the housing to be at least one of freely accessible on at least one end side of the housing in a first position, freely accessible on at least one other end side in a second position, and electrically connected to the respectively associated coil contacts, both in the first position and in the second position.

13. The switching device as claimed in claim 12, wherein the housing protrudes completely in the longitudinal direction over the coil connections, both in the first and in the second positions, on the freely accessible respectively opposite end side.

14. The switching device as claimed in claim 12, wherein the connection elements include an element length in the longitudinal direction, which exceeds the length of the housing.

15. The switching device as claimed in claim 12, wherein the first coil connection is designed to be identical to the second coil connection.

16. The switching device as claimed in claim 12, wherein the electrical connection between the connection elements and the associated connection elements is in the form of a clamping contact.

17. The switching device as claimed in claim 16, wherein the connection element includes a cutout, which extends in the longitudinal direction, into which the respective coil contact engages and which includes, in each case, at least two constrictions so as to form the clamping contact.

18. The switching device as claimed in claim 12, wherein the control coil is replaceable.

* * * * *